US011791146B2

(12) United States Patent
Williams et al.

(10) Patent No.: US 11,791,146 B2
(45) Date of Patent: Oct. 17, 2023

(54) MULTIPLEX CHARGE DETECTION MASS SPECTROMETRY

(71) Applicant: THE REGENTS OF THE UNIVERSITY OF CALIFORNIA, Oakland, CA (US)

(72) Inventors: Evan R. Williams, Oakland, CA (US); Conner C. Harper, Albany, CA (US); Andrew G. Elliott, Berkeley, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 119 days.

(21) Appl. No.: 17/465,045

(22) Filed: Sep. 2, 2021

(65) Prior Publication Data

US 2022/0059332 A1 Feb. 24, 2022

Related U.S. Application Data

(63) Continuation of application No. PCT/US2020/024667, filed on Mar. 25, 2020.
(Continued)

(51) Int. Cl.
*H01J 49/02* (2006.01)
*H01J 49/00* (2006.01)
*H01J 49/42* (2006.01)

(52) U.S. Cl.
CPC ..... *H01J 49/025* (2013.01); *H01J 49/0031* (2013.01); *H01J 49/0036* (2013.01); *H01J 49/4245* (2013.01)

(58) Field of Classification Search
CPC .. H01J 49/025; H01J 49/0031; H01J 49/0036; H01J 49/4245; H01J 49/426
(Continued)

(56) References Cited

U.S. PATENT DOCUMENTS 11,257,665 B2 * 2/2022 Jarrold ..... H01J 49/24
2009/0189069 A1 7/2009 Chen
(Continued)

FOREIGN PATENT DOCUMENTS

WO 2020198332 A1 10/2020

OTHER PUBLICATIONS

ISA/US, United States Patent and Trademark Office (USPTO), international search report and written opinion dated Jun. 30, 2020, related PCT international application No. PCT/US2020/024667, pp. 1-12, claims searched, pp. 13-18.
(Continued)

*Primary Examiner* — Kiet T Nguyen
(74) *Attorney, Agent, or Firm* — O'BANION & RITCHEY LLP; John P. O'Banion

(57) ABSTRACT

Systems and multiplexing methods for measuring the mass of multiple large molecules simultaneously using multiple ion trapping with charge detection mass spectrometry (CDMS) are described. The methods trap ions with a broad range of energies that decouple ion frequency and m/z measurements allowing energy measurements of each ion throughout the acquisition. The ion energy may be obtained from the ratio of the intensity of the fundamental to the second harmonic frequencies of the periodic trapping oscillation making it possible to measure both the m/z and charge of each ion. Because ions with the exact same m/z but different energies appear at different frequencies, the probability of ion-ion interference is significantly reduced. By maximizing the decoupling of ion m/z from frequency, the rate of signal overlap is significantly reduced making it possible to trap more ions and substantially reduce analysis time.

25 Claims, 6 Drawing Sheets

Related U.S. Application Data

(60) Provisional application No. 62/823,219, filed on Mar. 25, 2019.

(58) Field of Classification Search
USPC ..... 250/282, 281
See application file for complete search history.

(56) References Cited

U.S. PATENT DOCUMENTS

| | | | | |
|---|---|---|---|---|
| 2010/0059673 | A1 | 3/2010 | Makarov | |
| 2012/0112056 | A1 | 5/2012 | Brucker | |
| 2013/0068942 | A1 | 3/2013 | Verenchikov | |
| 2013/0270433 | A1 | 10/2013 | Ding | |
| 2018/0247805 | A1* | 8/2018 | Continetti ..... | H01J 49/0031 |

OTHER PUBLICATIONS

Harper, Conner C. et al., "Determining Energies and Cross Sections of Individual Ions Using Higher-Order Harmonics in Fourier Transform Charge Detection Mass Spectrometry (FT-CDMS)", J. A. Soc. Mass Spectrom. (2018) 29: 1861-1869, published online Jun. 2, 2018.

Keifer, David Z. et al., "Single-Molecule Mass Spectrometry", Mass Spectrometry Reviews, 2017, 36, 715-733, published online Feb. 12, 2016 in Wiley Online Library (wileyonlinelibrary.com).

Elliott, Andrew G. et al., "Simultaneous Measurements of Mass and Collision Cross-Section of Single Ions with Charge Detection Mass Spectrometry", Anal. Chem. 2017, 89, 7701-7708, published Jun. 16, 2017.

Smith, John W. et al., "Image Charge Detection Mass Spectrometry: Pushing the Envelope with Sensitivity and Accuracy", Anal. Chem. 2011, 83, 950-956, published Jan. 12, 2011.

Botamanenko, Daniel Y. et al., "Ion-Ion Interactions in Charge Detection Mass Spectrometry", J. Am. Soc. Mass Spectrom. (2019) 30:2741-2749, published online Nov. 1, 2019.

Chen, Ruidan et al., "Direct Charge Number and Molecular Weight Determination of Large Individual Ions by Electrospray Ionization Fourier Transform Ion Cyclotron Resonance Mass Spectrometry", Anal. Chem. 1994, vol. 66, No. 22, 3964-3969, Nov. 15, 1994.

Contino, Nathan C. et al., "Charge detection mass spectrometry for single ions with a limit of detection of 30 charges", International Journal of Mass Spectrometry 345-347 (2013) 153-159, published online Jul. 20, 2012.

Doussineau, Tristan et al., "Charge Detection Mass Spectrometry for the Characterization and Surface Area of Composite Nanoparticles", J. Phys. Chem. C 2015, 119, 10844-10849, Nov. 22, 2014.

Draper, Benjamin E. et al., "The FUNPET-a New Hybrid Ion Funnel-Ion Carpet Atomospheric Pressure Interface for the Simultaneous Transmission of a Broad Mass Range", J. Am. Soc. Mass Spectrom. (2018) 29:2160-2172, published online Aug. 15, 2018.

Draper, Benjamin E. et al., "Real-Time Analysis and Signal Optimization for Charge Detection Mass Spectrometry", J. Am. Soc. Mass Spectrom. (2019) 30:898-904, published online Apr. 16, 2019.

Dziekonski, Eric T. et al., "Voltage-induced frequency drift correction in fourier transform electrostatic linear ion trap mass spectrometry using mirror-switching", International Journal of Mass Spectrometry 410 (2016) 12-21, published online Oct. 25, 2016.

Dziekonski, Eric T. et al., "Utility of Higher Harmonics in Electrospray Ionization Fourier Transform Electrostatic Linear Ion Trap Mass Spectrometry", Anal. Chem. 2017, 89, 4392-4397, published Mar. 22, 2017.

Dziekonski, Eric T. et al., "A dual detector Fourier transform electrostatic linear ion trap utilizing in-trap potential lift", International Journal of Mass Spectrometry 405 (2016) 1-8, published online May 13, 2016.

Elliott, Andrew G. et al., "Mass, mobility and MSn measurements of single ions using charge detection mass spectrometry", Analyst, 2017, 142, 2760, published Jun. 14, 2017.

Elliott, Andrew G. et al., "Single Particle Analyzer of Mass: A Charge Detection Mass Spectrometer with a Multi-Detection Electrostatic Ion Trap", International Journal of Mass Spectrometry 414 (2017) 45-55, published online Jan. 15, 2017.

Elliott, Andrew G. et al., "Effects of Individual Ion Energies on Charge Measurements in Fourier Transform Charge Detection Mass Spectrometry (FT-CDMS)", J. Am. Soc. Mass Spectrom. (201 ) 30:946-955, published online Nov. 14, 2018.

Halim, Mohammad A. et al., "Infrared laser dissociation of single megadalton polymer ions in a gated electrostatic ion trap: the added value of statistical analysis of individual events", Phys. Chem. Chem. Phys., 2018, 20, 11959-11966, publshed Apr. 12, 2018.

Harper, Conner C. et al., "Multiplexed Charge Detection Mass Spectrometry for High-Throughput Single Ion Analysis of Large Molecules", Anal. Chem. 2019, 91, 7458-7465, published May 13, 2019.

Harper, Conner C. et al., "Direct observation of ion emission from charged aqueous nanodrops: effects on gaseous macromolecular charging", Chem. Sci., 2021, 12, 5185-5195, published Feb. 27, 2021.

Harper, Conner C. et al., "Enhanced Multiplexing in Fourier Transform Charge Detection Mass Spectrometry by Decoupling Ion Frequency from Mass to Charge Ratio", J. Am. Soc. Mass Spectrom. (2019) 30:2637-2645, published Nov. 12, 2019.

Heber, O. et al., "Electrostatic Ion Beam Trap", IEEE Symposium Conference Record Nuclear Science 2004, Filtration & Separation—Filtr Sep. 2. 1110-1113 Vol. 2. 10.1109/NSSMIC.2004.1462397.

Hogan, Joanna A. et al., "Optimized Electrostatic Linear Ion Trap for Charge Detection Mass Spectrometry", J. Am. Soc. Mass Spectrom. (2018) 29:2086-2095, published Jul. 9, 2018.

Johnson, Joshua T. et al., "A Miniaturized Fourier Transform Electrostatic Linear Ion Trap Mass Spectrometer: Mass Range and Resolution", J. Am. Soc. Mass Spectrom. (2019) 30:588-594, published Feb. 12, 2019.

Kafader, Jared O. et al., "Measurement of Individual Ions Sharply Increases the Resolution of Orbitrap Mass Spectra of Proteins", Anal. Chem. 2019, 91, 2776-2783, published Jan. 4, 2019.

Kafader, Jared O. et al., "STORI Plots Enable Accurate Tracking of Individual Ion Signals", J. Am. Soc. Mass Spectrom. (2019) 30:2200-2203, published Sep. 11, 2019.

Kafader, Jared O. et al., "Multiplexed mass spectrometry of individual ions improves measurement of proteoforms and their complexes", Nature Methods, vol. 18, Apr. 2020, pp. 391-394.

Keifer, David Z. et al., "Acquiring Structural Information on Virus Particles with Charge Detection Mass Spectrometry", J. Am. Soc. Mass Spectrom. (2016) 27:1028-1036, publshed Mar. 28, 2016.

Keifer, David Z. et al., "Spontaneous Mass and Charge Losses from Single Multi-Megadalton Ions Studied by Charge Detection Mass Spectrometry", J. Am. Soc. Mass Spectrom. (2017) 28:498-506, published Jan. 12, 2017.

Keifer, David Z. et al., "Charge detection mass spectrometry: weighing heavier things", Analyst, 2017, 142, 1654-1671, published Apr. 26, 2017.

Kiefer, David Z. et al., "Single-Molecule Mass Spectrometry", Wiley Periodicals, Inc., Mass Spec Rev 36:715-733, 2017, published online Feb. 12, 2016, Wiley Online Library (wileyonlinelibrary.com), DOI 10.1002/mas.21495.

Miller, Morgan E. C. et al., "Tapered image charge detector for measuring velocity distributions of submicrometer particle scattering", Rev. Sci. Instrum. 91, 063305 (2020); https://doi.org/10.1063/1.5142207, published online Jun. 16, 2020.

Ring, S. et al., "Fourier Transform Time-of-Flight Mass Spectrometry in an Electrostatic Ion Beam Trap", Anal. Chem. 2000, 72, 4041-4046, published online Jul. 29, 2000.

Contino, Nathan C. et al., "Charge Detection Mass Spectrometry with Resolved Charge States", J. Am. Soc. Mass Spectrom. (2013) 24:101-108, published online Nov. 30, 2012.

Pierson, Elizabeth e. et al., "Charge Detection Mass Spectrometry for Single Ions with an Uncertainty in the Charge Measurement of 0.65 e", J. Am. Soc. Mass Spectrom. (2015) 26:1213-1220, published online Apr. 14, 2015.

(56) References Cited

OTHER PUBLICATIONS

Schmidt, Henning T. et al., "Conetrap: A compact electrostatic ion trap", Nuclear Instruments and Methods in Physics Research B 173 (2001) 523-527.
Todd, Aaron et al., "Higher Resolution Charge Detection Mass Spectrometry", Anal. Chem. 2020, 92, 11357-11364, published Aug. 3, 2020.
Todd, Aaron R. et al., "Implementation of a Charge-Sensitive Amplifier without a Feedback Resistor for Charge Detection Mass Spectrometry Reduces Noise and Enables Detection of Individual Ions Carrying a Single Charge", J. Am. Soc. Mass Spectrom. 2020, 31, 146-154, published Dec. 17, 2019.
Zafman, D. et al., "High resolution mass spectrometry using a linear electrostatic ion beam trap", International Journal of Mass Spectrometry 229 (2003) 55-60.

* cited by examiner

MULTIPLEX CHARGE DETECTION MASS SPECTROMETRY

CROSS-REFERENCE TO RELATED APPLICATIONS

This application claims priority to, and is a 35 U.S.C. § 111(a) continuation of, PCT international application number PCT/US2020/024667 filed on Mar. 25, 2020, incorporated herein by reference in its entirety, which claims priority to, and the benefit of, U.S. provisional patent application Ser. No. 62/823,219 filed on Mar. 25, 2019, incorporated herein by reference in its entirety. Priority is claimed to each of the foregoing applications.

The above-referenced PCT international application was published as PCT International Publication No. WO 2020/198332 A1 on Oct. 1, 2020, which publication is incorporated herein by reference in its entirety.

STATEMENT REGARDING FEDERALLY SPONSORED RESEARCH OR DEVELOPMENT

This invention was made with Government support under Grant No. 1609866, awarded by the National Science Foundation. The Government has certain rights in the invention.

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

1. Technical Field

This technology pertains generally to charge detection mass spectrometry (CDMS) systems and techniques, and more particularly to CDMS methods for measuring the masses of large molecules, macromolecular complexes and synthetic polymers that are too large or heterogeneous for conventional mass spectrometry measurements.

2. Background

Native mass spectrometry (MS) where electrospray ionization (ESI) is used to transfer large macromolecules and macromolecular complexes directly from solution into the gas phase, enables the study of proteins, protein-ligand complexes, and other macromolecular complexes consisting of proteins, RNA, DNA, carbohydrates, etc., in their biological states. Native MS is a powerful tool in structural biology that provides complimentary information to other commonly used structural elucidation methods. Information about non-covalent macromolecular interactions, including stoichiometry, stability and assembly kinetics can be readily obtained with native MS even from solutions containing high concentrations (>100 mM) of nonvolatile salts.

Mass spectral peaks in an electrospray charge-state distribution of large (500+ kDa) macromolecular complexes can be broad due to sample heterogeneity as well as the adduction of salts and solvents. Mixtures are intrinsically heterogeneous but heterogeneity can also affect the analysis of relatively pure samples as a result of chemical modifications of the constituents of a macromolecular complex or multiple stoichiometries of the complex itself. As a result, charge-state distributions of individual components in mixtures of macromolecular complexes or synthetic polymers are often unresolved making it impossible to obtain mass information directly from an ESI mass spectrum.

A key challenge in extending the mass range of analytes amendable to such measurements is the need to resolve individual charge states in order to obtain molecular weight information from larger species, such as intact viruses. This is particularly challenging for complex samples, such as synthetic polymers or intrinsically heterogeneous macromolecular complexes, where charge-state distributions of the individual components in the mixture are unresolved. Signals for each component in an ensemble measurement can overlap and can lead to loss of resolved signal. In these cases, tandem mass spectrometry performed on a narrow range of m/z precursors can spread out the fragment ion signal over a wider range of mass to charge ratios (m/z) enabling some mass information to be obtained.

One method to overcome the problem of heterogeneity is to mass analyze individual ions so that the measurement of one ion does not interfere with the measurement of another. Single molecule mass measurements have been demonstrated using a variety of different methods, including nanoelectromechanical systems and with various types of mass spectrometers, including Fourier-transform ion cyclotron resonance (FT-ICR), Orbitrap, ion trap, cryodetector time-of-flight, and charge detection mass spectrometry (CDMS).

Several of these mass spectrometry methods can provide high mass measuring accuracy but this typically comes with the expense of long analysis times. The number of individual ion measurements necessary to characterize a sample depends on sample complexity. Characterization of mixtures that consist of a vast number of molecules or mixtures where components have very different concentrations requires more single ion measurements compared to the characterization of purer samples.

Weighing ions individually with charge detection mass spectrometry (CDMS) has the advantage that fast measurements are possible depending on the accuracy and sensitivity required. In CDMS, an ion passes through a detector, often a conducting tube, and the m/z is determined by the transit time through the detector tube or oscillation frequency inside a trap, and the z is determined from the magnitude of the induced charge. For highly charged ions, a detectible signal can be obtained from a single pass of the ion through the apparatus leading to a very rapid measurement of ion mass. CDMS can include multi-detector arrays, electrostatic ion traps or a combination of the two in order to signal average to improve the precision and the sensitivity of these measurements.

Electrostatic ion trap based CDMS instruments have been used to measure the masses and assembly kinetics of viruses up to 50 MDa, measure cargo loading into virus capsids, obtain accurate masses of large synthetic polymers and quantify lipoproteins that are important for assessing the risks of cardiovascular disease. Fragmentation and even MS measurements have been demonstrated for a single ion inside a CDMS instrument. Collision cross sections of individually weighed ions can be obtained from changes in the frequency of the ion motion inside the electrostatic ion trap as a result of collisions with background gas.

One limitation of trapping CDMS technology is the need to weigh single ions individually in order to eliminate potential interferences between the signals of multiple ions or ion-ion interactions that can potentially interfere with these measurements.

In experiments where ions that do not produce a detectable signal upon a single pass through a detector tube are measured, ion trapping occurs by systematically lowering the potential of the front of the trap to admit ions and then raising the trap potential to trap and weigh the ion. In order to avoid trapping multiple ions and to efficiently acquire data, the ion current must be adjusted so that on average, it is nearly equally probable to have no ions, a single ion or multiple ions in the trap.

Thus, under optimum conditions, a single ion is trapped in only 37% of the measurements. However, this necessitates that about two thirds of the measurements contain either no ions or multiple ions and therefore, no ion masses are obtained from the majority of data that is acquired.

The probability of trapping just one ion is significantly reduced if the ion current is either higher or lower than the optimum value making the ion current an essential parameter to optimize for efficient mass measurements. In order to achieve the optimum single ion trapping conditions, the ion current has to be carefully regulated so that a single ion is trapped in only 37% of the measurements. Lower currents lead to fewer single ion trapping events and higher currents lead to more trapping of multiple ions at the expense of single ion events. Thus, under optimum single ion conditions, fewer than four ions can be weighed per second using 100 ms trap times and nearly ⅔ of the measurements, which contain no or multiple ions, are discarded. A mass histogram consisting of approximately 6700 ions can be acquired in about 30 minutes using a 100 ms trapping period and optimum ion current, for example.

Accordingly, there is a need for systems and methods that enable efficient weighing of individual masses of multiple ions that are trapped in CDMS with precisions and accuracies that are indistinguishable from those made of individually trapped ions with acquisition times that are substantially reduced.

BRIEF SUMMARY

Systems and methods for multiplexed charge detection mass spectroscopy for high throughput single ion analysis of large molecules are provided. The methods are particularly useful for samples that are not amenable to analysis using conventional mass spectrometry measurements. Charge detection mass spectrometry methods are provided for measuring the masses of large molecules, macromolecular complexes and synthetic polymers that are too large (e.g. between 10 MDa to about 1 TDa) or heterogeneous for conventional mass spectrometry measurements. This is made possible by weighing individual ions in order to avoid interferences between ions. The multiplexing methods measure the masses of many ions simultaneously with CDMS instrumentation with ion trapping features.

Weighing single ions with charge detection mass spectrometry makes it possible to obtain the masses of molecules of essentially unlimited size even in highly heterogeneous samples. However, producing a mass histogram that is representative of all of the components in a mixture requires substantial measurement times. Multiple ions can be trapped to reduce analysis time, but ion signals can often overlap.

The methods enable the efficient weighing of individual masses of multiple ions that are trapped in CDMS with precisions and accuracies that are indistinguishable from those made of individually trapped ions. The methods take advantage of the ability to obtain ion energies throughout the measurement process. By trapping ions with a range of energies, the ion signal is spread over a broad range of frequencies even for ions that have the exact same m/z. This significantly reduces the probability of overlapping ion signals. The measurements also show that ion-ion interactions are not a limitation to the current ability to weigh individual ions in CDMS. The methods enable at least an order of magnitude improvement in the typical time required to obtain a mass histogram with CDMS and provides additional gains in ion measurement efficiency.

Ions with different energies induce different signal patterns inside an electrostatic ion trap. The sum of the amplitudes of the fundamental and second harmonic frequencies in the Fourier transform of the induced time domain signal, which has been used to obtain the ion charge, depends on both ion energy and charge. Additionally, the fundamental frequencies of ions increase over time as ions lose energy by collisions with background gas and solvent loss from larger ions.

A key issue, however, is when two or more ions of the same or similar m/z are introduced into the trap and the resulting signals overlap in frequency. This greatly complicates individual ion mass measurements and overlap is most likely for homogenous samples where the number of charge states in a charge state distribution is limited. This problem of ion overlap can be significantly reduced by decoupling the ion frequency from the ion m/z. This decoupling is accomplished by introducing a relatively broad distribution of ion energies per charge into the ion trap and measuring the energy of each ion in situ. A greater than 10-fold gain in speed was demonstrated with multiple single ion measurements using this frequency to m/z decoupling scheme.

In one embodiment, ions with a broad range of kinetic energies are trapped. The energy of each ion is obtained from the ratio of the intensity of the fundamental to second harmonic frequency of the periodic trapping oscillation making it possible to measure both the m/z and charge of each ion. Because ions with the exact same m/z but with different energies appear at different frequencies, the probability of ion-ion interference is significantly reduced.

In another embodiment, multiple ions are trapped simultaneously and the energy per charge of each ion is selected. The m/z of each ion is obtained from the energy per charge and measured ion oscillation frequency. The charge of each ion is also measured. Finally, the ion mass is then derived from the m/z and charge measurements. In this way, the measurement time is greatly reduced compared to measuring the mass of individually trapped ions.

In a further embodiment, ions having a narrow range of energy per charge as determined by energy selective ion optics are simultaneously trapped and charge and oscillation frequency time domain signals are measured. The mass to charge ratio for each ion is calculated from the average energy per charge as determined by the energy selective ion optics and the measured ion oscillation frequency.

In another embodiment, the instrumentation is designed to optimize ion energy variance prior to injection if the ions into the detector trap. Multiple differentially pumped stages of ion optics, including an ESI source, ion funnel, ion optics lenses, and quadrupole ion traps equipped with asymptotic guide rods will desolvate, thermalize, and then inject ions with a variable energy distribution into the electrostatic ion trap where ion detection and measurement occurs.

According to one aspect of the technology, a CDMS system with a multiplexing method that makes it possible to measure the masses of many ions simultaneously.

Another aspect of the technology is to provide a CDMS trapping system where the probability of ion-ion interference is significantly reduced because ions with substantially the same or the same m/z, but with different energies per charge, oscillate with different frequencies.

Another aspect of the technology is to provide a CDMS system that produces and simultaneously traps one or more ions with a range of energies in an electrostatic ion trap thereby decoupling the mass to charge ratio (m/z) and the ion oscillation frequency measurements.

A further aspect of the technology is to provide a CDMS system with a trap that maximizes the decoupling of ion m/z from frequency by using a broad range of ion energies significantly reducing the rate of signal overlap making it possible to simultaneously trap and measure the mass of more ions.

Further aspects of the technology described herein will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWINGS

The technology described herein will be more fully understood by reference to the following drawings which are for illustrative purposes only.

DETAILED DESCRIPTION

Referring more specifically to the drawings, for illustrative purposes, embodiments of a charge detection mass spectrometry (CDMS) system and methods for multiplexed measurements of individual masses of multiple simultaneously trapped large molecules, macromolecular complexes and synthetic polymers etc. that are too large or heterogeneous for conventional mass spectrometry measurements are generally shown. Several embodiments of the technology are described generally in FIG. 1 to FIG. 7 to illustrate the characteristics and functionality of the apparatus, systems and methods. It will be appreciated that the methods may vary as to the specific steps and sequence and the systems and apparatus may vary as to structural details without departing from the basic concepts as disclosed herein. The method steps are merely exemplary of the order that these steps may occur. The steps may occur in any order that is desired, such that it still performs the goals of the claimed technology.

Figure 1:
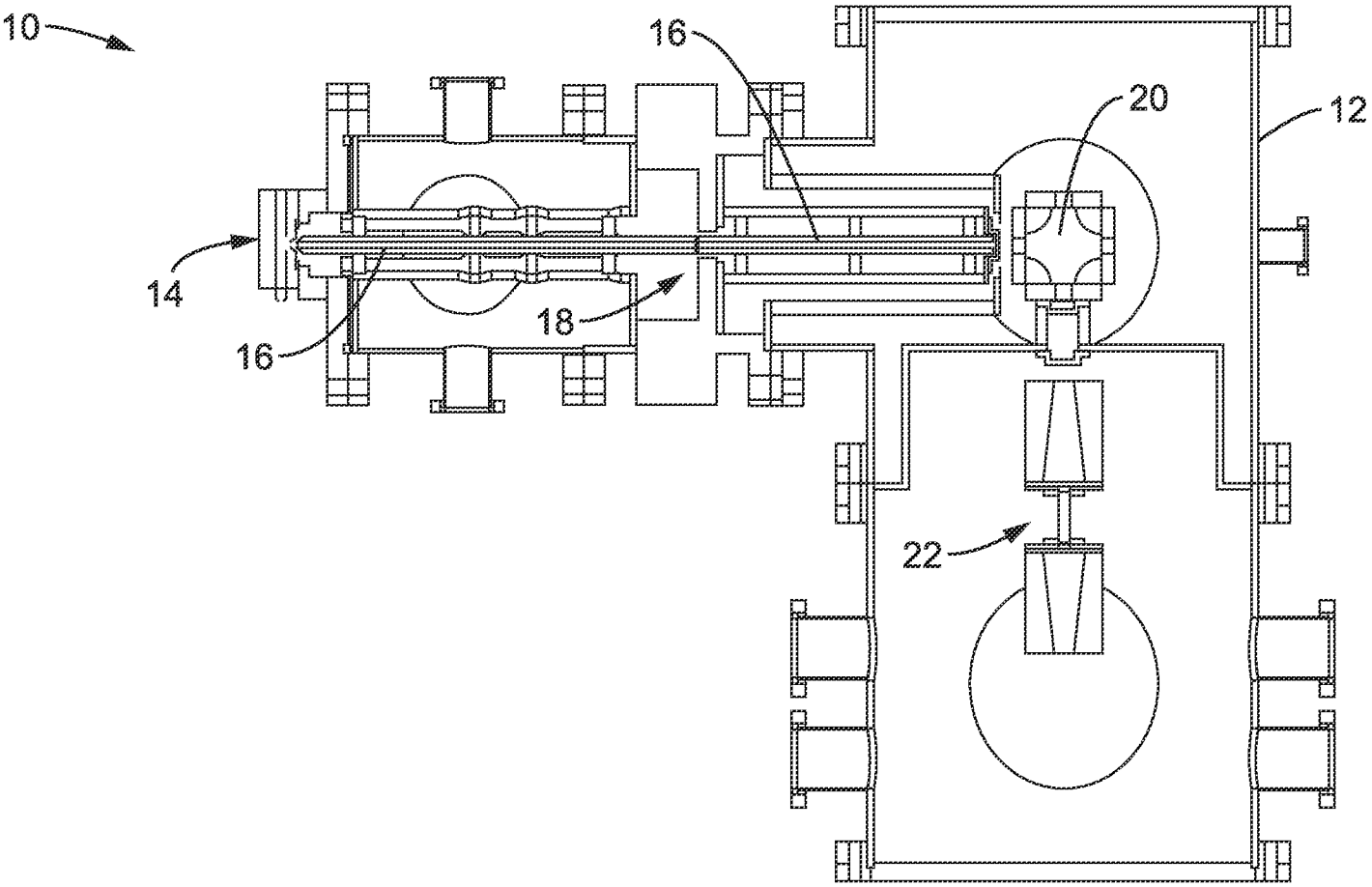
FIG. 1 is a schematic cross-sectional view of a charge detection mass spectrometry (CDMS) device capable of multiplexed ion mass measurement according to one embodiment of the technology.

Turning now to FIG. 1, one embodiment of a CDMS system capable of performing the mass measurement methods is shown schematically and is used to illustrate the technology. The typical CDMS system 10 has a detecting apparatus 12 with an ion source 14 for electrospray ionization of a sample. Ions produced at atmospheric pressure from the ion source 14 are commonly transported to a mass analyzer operating in a vacuum with one or more radiofrequency (RF) quadrupole guides 16 and a gate valve 18.

Ion guides 16 of the ion trap feature that are used are generally quadrupoles, hexapoles or octopoles that are radially confining and significantly reduce ion losses and optimize the quality of the spatially focused ion beam entering the analyzer. The ion guides 16 may be solid (upper) or segmented (lower) as illustrated schematically in FIG. 2 for generating and collecting ions with a variable ion energy spread. In the upper embodiment of FIG. 2, extraction rods at a constant DC potential arranged around a RF quadrupole guide result in a spread of ion energies that can be spatially focused. A similar effect can be achieved with a series of small RF guides with varying DC offsets (lower).

In the embodiment shown in FIG. 1, a turning quadrupole 20 is used to turn the ion beam (not shown) for entrance into the electrostatic ion trap (cone trap) and detector tube of the detector 22. The system 10, including detector 22, ion guides 16 and ion source 14 components, are controlled by a controller with a processor, data storage and display and associated functions.

Figure 3:
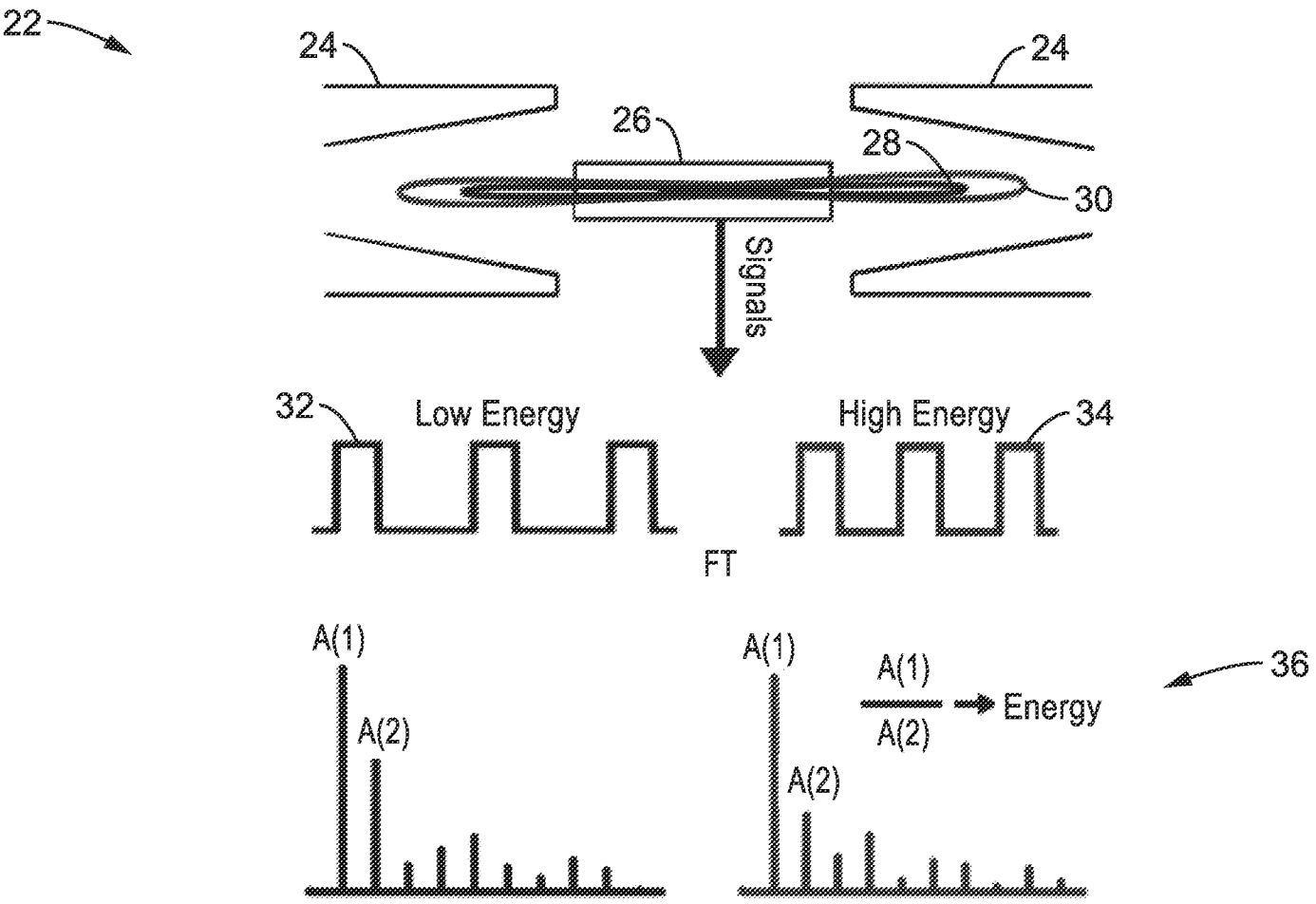
FIG. 3 is a schematic side view of an electrostatic ion trap element of the CDMS system of FIG. 1 with trapped oscillating ions producing time domain signals with a characteristic duty cycle associated with ion energy. This is manifested in the Fourier transform of the data as a different pattern of harmonic frequency amplitudes. The ratio of any two of these harmonic amplitudes can be used to measure the ion energy.

FIG. 3 illustrates schematically the detection of ion mass and energy with an electrostatic cone trap 24 and detector tube 26 of the detector 22 and how ion energies are determined from oscillation frequencies in charge detection mass spectrometry. Here, the multiplexing methods makes it possible to measure the masses of many ions simultaneously in CDMS.

Ions with a broad range of kinetic energies are trapped. As lower energy ion 28 and higher energy ion 30 pass back and forth through the conductor, for example, they induce an image charge that is proportional to the charge of the ion. The velocity of the individual ion is obtained from the tube 26 length and from the duration of the image charge signal that corresponds to the ion entering and exiting the tube 26. The m/z of the ion is determined from its energy and velocity.

The time domain signal produced by an ion oscillating within an electrostatic trap 22 has a characteristic duty cycle associated with the ion energy as shown with the lower energy 32 signal and the higher energy signal 34 of FIG. 3. This may be manifest in the Fourier transform of the data as a different pattern of harmonic frequency amplitudes 36 illustrated at the bottom of FIG. 3. The ratio of any two of these harmonic amplitudes can be used to measure the ion energy. Although a segmented Fourier transform or a short-time Fourier transform (STFT) are preferred, any method that will turn time domain data into frequency domain data could be used including filter diagonalization methods, least squares fitting methods and discrete wavelet transform methods.

The energy of each ion is obtained from the ratio of the Fourier transform amplitudes of the fundamental to the second harmonic frequencies of the periodic trapping motion making it possible to measure both the m/z and charge of each ion dynamically. Because ions with the exact same m/z but different energies will appear at different frequencies, the probability of ion-ion interference is significantly reduced.

Figure 2:
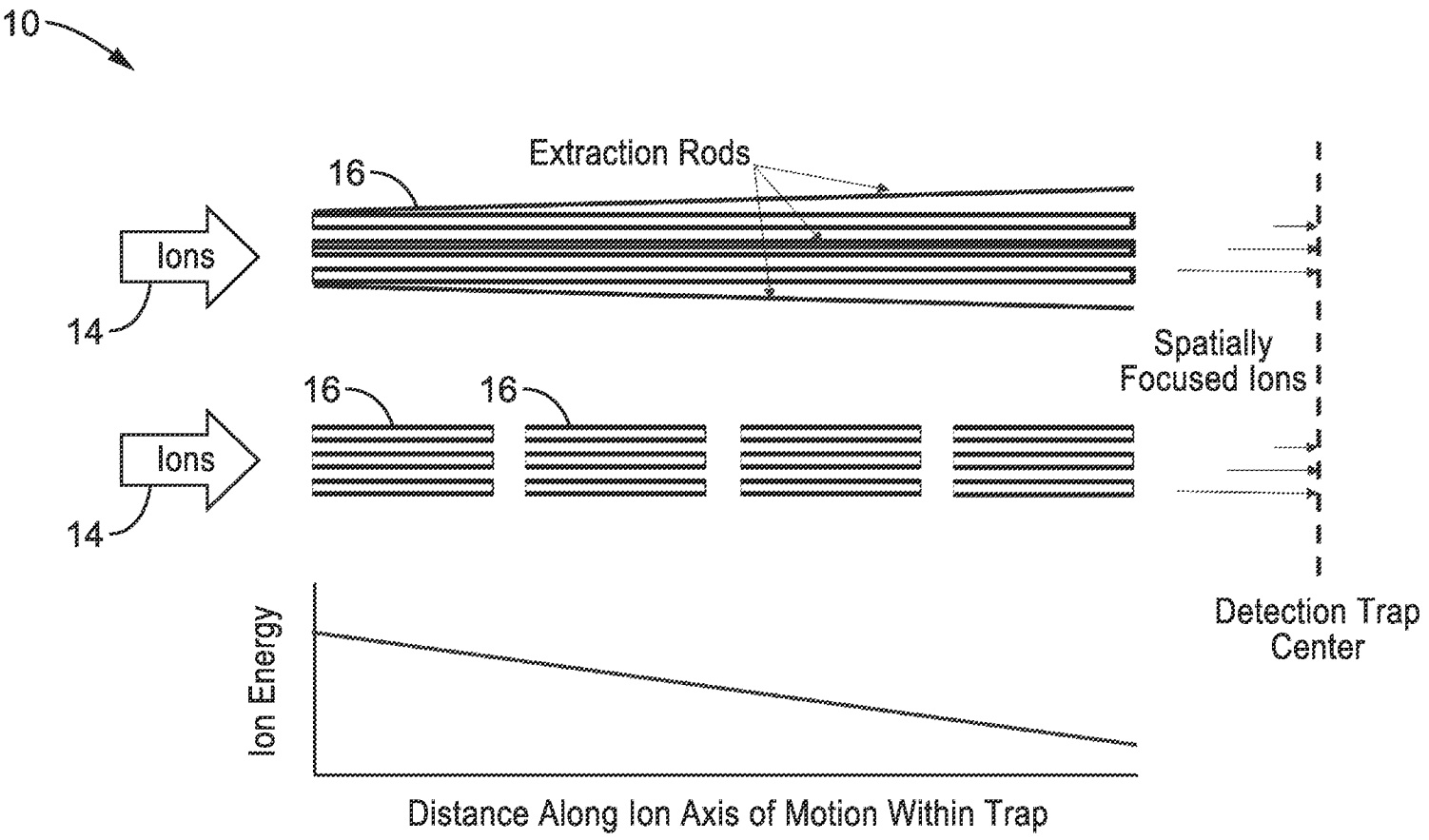
FIG. 2 is a schematic side view of solid and segmented ion guides for trapping and generating ions with a variable ion energy spread. Extraction rods at a constant DC potential arranged around a RF quadrupole trap produce a spread of ion energies that can be spatially focused and a similar effect is achieved with a series of small RF traps with varying DC offsets.

In order to achieve high-throughput, multiplexed CDMS measurements, the preferred embodiment produces ions from an electrospray (ESI) ion source 14 and ion funnel. Ions are then collected and thermalized in a rectilinear quadrupole collecting or trapping stage to remove any correlation between mass and energy caused by aerodynamic acceleration from the ion source 14. This first ion guide 16 preferably has asymptotic guide rods arranged at an angle to the solid quadrupole as shown in FIG. 2. These rods are held at a constant DC potential, forming a downstream gradient that efficiently transfers the thermalized ions to a second rectilinear quadrupole guide as shown in FIG. 1. The second guide-trap may also be equipped with asymptotic field guide rods, but a DC potential pulse is applied to the rods at the same time the downstream exit of the trap is opened. This produces a potential gradient where ions closer to the upstream side of the trap at the time it opens will have higher energies relative to ions near the downstream exit. This energy variance generation step is important because it allows the distribution of ion energies to be tuned via the magnitude of the DC potential pulse applied to the guide rods. Ion energies can be carefully optimized to match the range of energies that have stable trajectories in the detector trap 22 and thereby maximize decoupling and analysis speed. An additional benefit of this instrumental setup is that it naturally accumulates and pulses ions into the detector trap during the brief period that it is open between trapping events. This can significantly lower the limit-of-detection for CDMS, which is already a sensitive technique.

Figure 4:
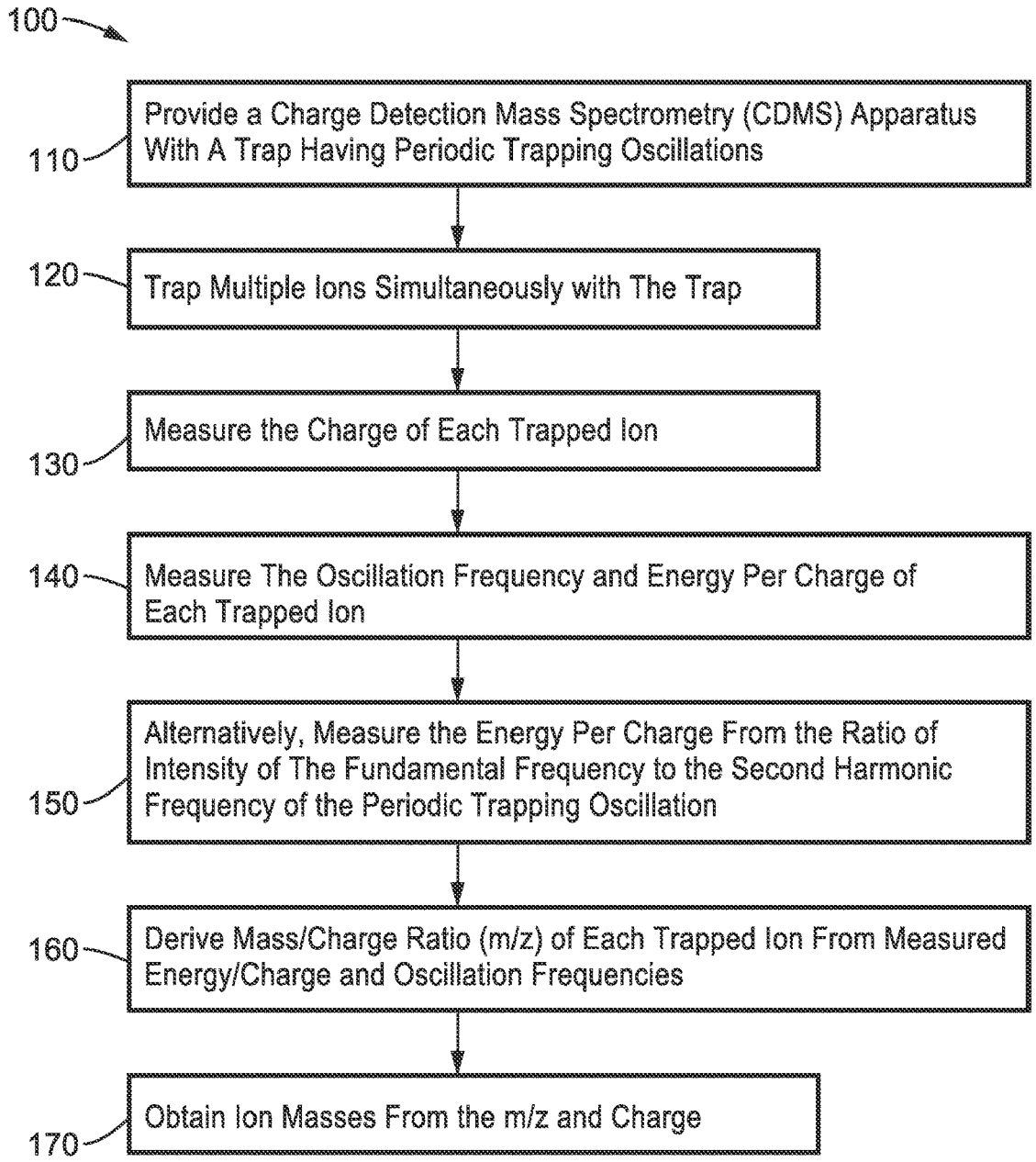
FIG. 4 is a schematic block system diagram of a method for measuring individual masses of multiple simultaneously trapped ions with charge detection mass spectrometry according to one embodiment of the technology.

Referring now to FIG. 4, one method 100 for multiplexed charge detection mass spectrometry is shown schematically. The methods are particularly useful for samples such as large molecules and macromolecular complexes that are not amenable to analysis using conventional mass spectrometry measurements. The multiplexing method 100 makes it possible to measure the masses of many ions simultaneously in CDMS.

In the embodiment of the method 100 shown in FIG. 4, a CDMS system is provided at block 110. Single ion Fourier transform charge detection mass spectrometry (FT-CDMS) systems, where individual ions are confined in an electrostatic ion trap and the m/z of each ion is obtained from its oscillation frequency, are particularly preferred.

Ions with range of kinetic energies per charge determined by energy selective ion optics are trapped in the step of block 120 of FIG. 4. Energy selective optics that can produce a controllable, broad range of ion energies per charge, such as those of FIG. 2, are particularly preferred. Trapping ions with a broad range of energies per charge spreads the ion signals over a broad range of frequencies even for ions that have the exact same m/z. The ability to analyze the energy per charge of each ion throughout the trapping time makes it possible to trap and measure the mass of ions that have a broad range of energies per charge.

The charge of each trapped ion is then measured at block 130 and the oscillation frequency of each trapped ion is measured at block 140. In one embodiment, the charge and frequency measurements of block 130 and block 140 occur simultaneously. The energy per charge of each ion may be approximated by the average energy per charge of a narrow band of energies determined by the tuning parameters of energy selective ion optics.

Alternatively, the energy per charge can be directly measured from the ratio of intensity of the fundamental frequency to the second harmonic frequency of the periodic trapping oscillations at block 150. The energy of each ion is obtained at block 150 from the ratio of the amplitude of the fundamental to second harmonic frequency of the Fourier transformed signal making it possible to measure both the m/z and charge of each ion. Because ions with the exact same m/z but with different energies appear at different frequencies, the probability of ion-ion interference is significantly reduced.

The measured energy and oscillation frequencies are used to determine the mass per charge (m/z) of each ion at block 160. The ion mass of each trapped ion is measured from the m/z and charge values at block 170.

Figure 5:
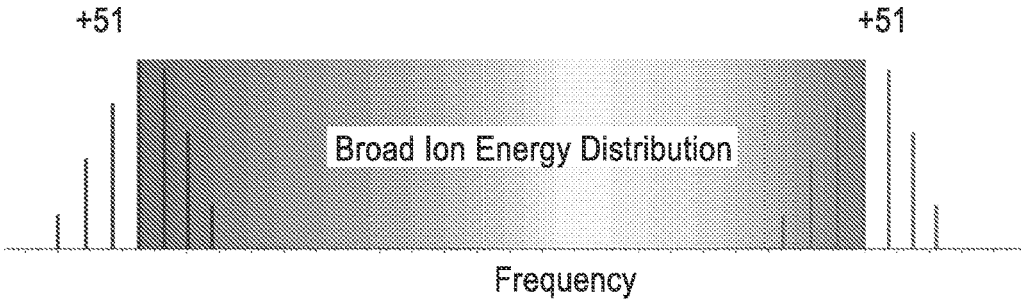
FIG. 5 is a CDMS frequency line spectra showing a broad energy distribution when the m/z and frequency are no longer directly coupled when the ion energy is varied. An ion with a given m/z can be observed anywhere within a range of frequencies that is determined by the width of the ion energy distribution.

One important issue arises when two or more ions of the same or similar m/z are introduced into the trap and the resulting signals overlap in frequency. This greatly complicates individual ion mass measurements and is most likely observed with homogenous samples where the number of charge states in a charge state distribution is limited. This problem of ion overlap can be significantly reduced by decoupling the ion frequency from the ion m/z, as illustrated in FIG. 5. This decoupling is accomplished by introducing a relatively broad distribution of ion energies per charge into the ion trap and measuring the energy of each ion in situ. A greater than 10-fold gain in speed has been demonstrated with multiple single ion measurements using the frequency to m/z decoupling scheme.

In FT-CDMS, where ions are trapped and oscillate with a period frequency, the relationship between ion frequency, f, and m/z, given in the following equation:

$$\frac{m}{z} = \frac{C(E)}{f^2}$$

C(E) is a function of ion energy, the trapping voltage, and the trap geometry. This value is determined from ion trajectory simulations. Thus, the ion frequency depends on ion energy, through C(E), as well as ion m/z.

Because the duty cycle of the ion signal depends on ion energy, the amplitudes of the fundamental and harmonic frequencies also depends uniquely on the ion energy. Thus, the ion energy at any time throughout the measurement can be obtained from the ratio of the fundamental amplitude to that of the second harmonic. This ratio of harmonics may also be used to correct the measured fundamental amplitudes for differing harmonic content in order to obtain a more accurate measure of z. These values of m/z and z are multiplied to obtain the individual mass of each ion.

In most FT-CDMS trapping experiments the C(E) is kept constant with a narrow bandwidth of energies selected by using energy selective ion optics, such as a dual hemispherical deflection analyzer or a turning quadrupole known in the art. The narrowest spread of ion energies reported in single ion CDMS is a standard deviation of 0.3% of the nominal energy, which makes possible the charge state resolution of analytes as large as 465 kDa.

The necessity for energy selective ion optics can be eliminated if the ion energy is determined directly from individual ion signals. Because the duty cycle of the time domain ion signal in FT-CDMS depends on the ion energy, the amplitudes of the fundamental and harmonic frequencies also depend on ion energy. Thus, the ratio of the fundamental and second harmonic frequencies can be used to dynamically determine the ion energy throughout the entire trapping period. This measurement of ion energy does not depend on the ion frequency.

Dynamically measuring ion energies makes it possible to take advantage of the ion m/z and frequency decoupling that occurs as result of non-uniform ion energies in CDMS. FIG. 5 demonstrates the advantages that can be gained by intentionally decoupling ion m/z and frequency. The decoupling of ion frequency and m/z is important to increasing the number of ions that can be simultaneously analyzed in a single CDMS trapping event. Because FT-CDMS is based on individual ion frequency and amplitude measurements, two or more ions with interfering frequencies and convolved amplitudes provide no mass information. For example, if two ions with the same m/z and energy are trapped simultaneously their signals would interfere and the mass of neither ion could be readily determined. This is almost certain to occur as the number of trapped ions approaches the number of peaks in the charge-state distribution of a relatively pure sample of a large molecule, significantly limiting the number of ion measurements that can be performed simultaneously.

By maximizing the frequency range in which ions of a given m/z can be observed (FIG. 5), the probability of interferences is greatly reduced. This makes it possible to introduce and simultaneously measure a greater number of ions in a single trapping event, decreasing the time required to measure a representative mass spectrum.

Another advantage of single ion CDMS is that ion motion does not have to be coherent in order to measure ion masses. In conventional methods of CDMS for ensemble measurements of low charge state ions, however, ion motion must be coherent in order measure ion mass. Space-charge effects can be observed when the number of charges of trapped ions with similar m/z exceed a certain value.

As a consequence, ion coherence is very undesirable in multiplexed ion measurements because coherent ions with the same or nearly the same m/z and frequency will experience more ion-ion interactions. Incoherent ions interact for only brief periods of time, making it possible to simultaneously trap a greater number of ions without significant space-charge effects. Decoupling ion frequency from m/z decreases ion coherence as ions with the same m/z are not constrained to a single oscillation frequency. Incoherence can be also achieved by using ion injection times that are longer than the oscillation period of the lowest velocity ions, effectively randomizing the initial phase of ion oscillation.

The technology described herein may be better understood with reference to the accompanying examples, which are intended for purposes of illustration only and should not be construed as in any sense limiting the scope of the technology described herein as defined in the claims appended hereto.

EXAMPLE 1

To demonstrate the possible gains in analysis speed with current instrumentation with multiple ion trapping, simulations calculating the frequency and overlap rate of ions with different mass, charge, and energy ranges were performed.

Weighing single ions with charge detection mass spectrometry (CDMS) makes it possible to obtain the masses of molecules of essentially unlimited size even in highly heterogeneous samples, however producing a mass histogram that is representative of all of the components in a mixture requires substantial measurement time. While multiple ions can be trapped to reduce analysis time, the resulting ion signals will often overlap.

To find the maximum possible decrease in data acquisition times using existing CDMS instrumentation, simulations of multiple ion trapping events were performed that accounted for the effects of many different variables, including the number of ions within a single trapping event, ion charge, charge-state distribution width, ion mass, ion mass distribution width, nominal ion energy, ion energy distribution width, and FT peak width.

Each ion in the simulation was assigned with mass, charge, and energy values randomly generated from Gaussian probability distributions where the mean and standard deviation for each property were given as parameters in the simulation. For ion mass and charge, parameters were chosen to match a real analogue as closely as possible. Ion energy distributions were chosen to match instrument conditions that enable different extents of frequency and m/z decoupling.

The electrostatic cone trap used in previous CDMS experiments has been shown to stably trap a relatively broad range of ion energies (±~12% of trap centroid energy). For the charge state distribution, the randomly generated values were rounded to the nearest integer value. The ion energies and the additional parameter of the ion trap voltage were then used to calculate the values of C(E), which, along with the individual ion masses and charges, were used to calculate the frequency of each simulated ion. In a real CDMS trapping event, if the frequencies of two or more ions are closer than the characteristic FT peak width, they interfere with each other, making it difficult to properly measure the exact frequency and charge of the ions. Thus, in these simulations, ions in the same trapping event that have frequencies closer than the FT peak width were discarded.

For signals from homogeneous samples, ions with the same m/z have frequencies that overlap and interfere, reducing the effectiveness of multiplexing in procedures where ions have the same energy per charge. By maximizing the decoupling of ion m/z from frequency using a broad range of ion energies, the rate of signal overlap was significantly reduced making it possible to trap more ions.

Under optimum decoupling conditions, measurement speeds that were nearly 50 times greater than that of prior CDMS experiments were possible for RuBisCO (517 kDa). The reduction in overlap due to decoupling also resulted in more accurate quantitation in samples that contained multiple analytes with different concentrations.

Collisions with background gas, neutral mass losses, and fragmentation all effect CDMS oscillation frequencies. If the ion signal frequency changes over the length of the FT, the peak width is broadened leading to signal amplitude that is distributed over multiple frequencies. This reduces the signal peak amplitude, resulting in a lower measured value of ion charge. Therefore, short-time Fourier transforms (STFT) were implemented to overcome this effect by transforming short segments where the change in ion frequency is negligible. The amplitude data from each short segment was then averaged to calculate the charge, yielding the same precision typically obtained by using a single long FT on stationary signals.

For multi-ion CDMS, the best choice of STFT segment length is the longest period that does not result in broadened peak widths and lowered amplitudes. This can be determined by analyzing the peak widths of the analyte of interest as function of FT length. Traps where ion motion is more harmonic will lead to lower energy dependence on the oscillation frequency. In this example, a virtual FT segment length of 50 ms corresponding to a 40 Hz base peak width was used in all simulations to make the results readily comparable to previous work.

Using the simulation schemed escribed above, the optimum ion count and the gain in overall ion acquisition speed was determined for two test analytes under different instrumental conditions. The analytes selected for simulation were well studied large molecules known in the art. Analyte A was analogous to a sample of 8 MDa polyethylene glycol (PEG) with very broad mass and charge distributions. Analyte B was analogous to a sample of 517 kDa RuBisCO that has relatively narrow mass and charge distributions. Both analytes were simulated using three different sets of ion energy parameters, narrow (0.3% standard deviation), intermediate (3% standard deviation) and broad (7.3% standard deviation) energy distributions corresponding to different instrumental conditions. The trap voltage for the broad energy distribution was set to its current maximum of 500 V so that the absolute width of stable ion energies was as large as possible.

The simulations demonstrated that decoupling the frequency and m/z in CDMS greatly increases the number of ions which can be simultaneously analyzed, particularly for homogeneous samples. For analyte A, the gain in analysis speed was nearly linear with ion count for each different energy distribution. This was because the extremely broad mass and charge-state distributions of A result in a very broad range of possible frequencies regardless of the ion energy distribution and ion overlap events are rare even at higher ion counts. While greater decoupling was not observed to yield large relative gains in ion throughput, the results suggest that very large gains are possible for heterogeneous samples by measuring many ions using CDMS.

The maximum gain in analysis speed and corresponding ion count vary significantly depending on the extent of decoupling. Simulations of analyte A at ion counts up to 100 resulted in ion throughput gains of up to ~160×.

In the case of relatively homogeneous samples, such as analyte B, ion frequency and m/z decoupling had a much more significant effect on the ion throughput gains. Analyte B ions with a narrow distribution of ion energies reached a maximum gain of ~19× at an ion count of ~20 and a maximum gain of ~48× at an ion count of ~45 at the broadest distribution, meaning that decoupling has the potential to more than double the overall analysis speed for analyte B ions using optimum ion currents.

The close correlation between the simulations and previous experimental results suggests that these simulations serve as reasonably accurate predictors of CDMS data strengthening the conclusions that further gains in CDMS ion analysis speed through ion multiplexing and decoupling frequency from m/z are possible. Another important conclusion from these data is that while the absolute gains in analysis speed depend on the ion count and analyte identity, it is always advantageous to maximize the extent of decoupling to obtain more usable ion signal.

In addition to gains in analysis speed, decoupling ion frequency and m/z in CDMS can also yield greater dynamic range and provide more accurate quantitation in procedures where multiple ions are trapped. Ions within the most abundant charge states are more likely to overlap in frequency and be discarded, resulting in a histogram skewed towards low abundance ions. Resolution also decreases as a function of ion count. Outlier ions with frequencies that fall in between charge states are less likely to experience overlap and are therefore retained disproportionally. Although the charge state resolution in the frequency histogram is lost, the charge state distribution in m/z space is resolved because the m/z of each ion is obtained from both the frequency and ion energy measurements. Thus, no mass information is lost as a result of this frequency decoupling method as long as the energy and charge of each ion are measured individually.

While the skewing effect observed in the narrow and intermediate energy distributions does not affect the mass measurement of individual ions, it can affect the accuracy of quantitation and dynamic range of a sample containing two or more analytes. Decoupling ion m/z and frequency via a broader energy distribution can help mitigate this effect. If the low abundance ion occupies a different m/z and frequency space than that of the high abundance ion, it will very rarely experience overlap due to its low ion count.

In multi-ion CDMS experiments, a more accurate measure of the true abundance ratios can be obtained by selecting trapping events that have the lowest number (ideally zero) of overlap events to use in the abundance calculation. Only multi-ion events with zero overlap will provide exact quantitation.

Regardless of the methods used, abundances measured using a broad energy distribution will have significantly reduced quantitation error due to the significantly lower probability of overlap at all ion counts. This advantage, in addition to the larger gains in analysis speed, make the maximum decoupling of ion frequency and m/z highly advantageous for multi-ion CDMS.

In summary, the simulations of ion signals for existing CDMS instrumentation demonstrate that the time necessary to acquire single ion CDMS mass histograms can be greatly reduced by analyzing many simultaneously trapped ions. This gain in analysis speed can be increased further by decoupling ion m/z from the measured ion frequency. Decoupling may be achieved by introducing ions with a broad range of energies into the CDMS ion trap. No mass information is lost as a result of decoupling because ion energies are measured dynamically for each individual ion.

EXAMPLE 2

To further demonstrate the multiplexing methods for measuring the individual masses of multiple simultaneously trapped ions in charge detection mass spectrometry (CDMS), RuBisCO, a 517 kDa protein complex consisting of 16 protomers, was analyzed using a home-built charge detection mass spectrometer like that shown schematically in FIG. 1. This molecular complex was chosen to illustrate the multi-ion detection method because the sample can be made relatively pure, and the charge states are relatively low compared to many other analytes effectively analyzed by single ion CDMS. In addition, the complex was small enough to analyze using conventional time-of-flight MS making it possible to compare this single ion method with measurements from more traditional native MS instrumentation.

Generally, the multiplexing method makes it possible to measure the masses of many ions simultaneously in CDMS. Ions with a broad range of kinetic energies were trapped. If a broad range of ion energies are introduced into the trap, the m/z and frequency are no longer directly coupled. This can be illustrated in FIG. 5 where an ion with a given m/z can be observed anywhere within a range of frequencies that is determined by the width of the ion energy distribution. The energy of each ion was obtained from the ratio of the intensity of the fundamental to second harmonic frequency of the periodic trapping motion making it possible to measure both the m/z and charge of each ion. Because ions with the exact same m/z but with different energies appear at different frequencies, the probability of ion-ion interference was significantly reduced.

Ions were formed by nanoelectrospray ionization of a 5 μM solution of RuBisCO and 10 μM solution of bovine serum albumin (BSA, Sigma Aldrich) both in a 100 mM aqueous ammonium acetate solution using borosilicate capillaries with tips that are pulled to a diameter of ~1.5 μm. Ions entered the instrument through a modified Z-Spray source and passed through two RF-only quadrupole ion guides and entered a turning quadrupole (Ardara Technologies) that was used to select a range of ion energies and direct the ions into a detection chamber that contains an electrostatic cone trap and detector tube. The pressure inside the trap was approximately $3\times10^{-9}$ Torr.

The potential of the upstream cone electrode was lowered to 0.0 V for 1 ms to eject ions from the prior measurement and to allow new ions to enter the trap. The potential was subsequently raised to match the downstream cone electrode (330 V) for a specified trapping time of 1.0 s. Ions passing through the detector induced a charge pulse that was amplified by a CoolFET charge-sensitive preamplifier and linear voltage amplifier (Amptek). Because the ions had less than the ~300 e necessary for direct observation in the time domain, a control processor with a Python program using short-time Fourier transforms (STFT) was used to analyze the data and control the system. A 50 ms segment was analyzed in overlapping steps of 5 ms. The 50 ms segment length was chosen to balance minimizing FT peak widths with amplitude dampening that was caused by ion frequency shifts with time.

To convert the STFT frequency data from each trapping event into individual ion mass values, a peak picking algorithm was used to identify peaks in each five ms step of the entire transform. Because the ion trapping frequency can vary with time, the peaks in adjacent five ms time intervals were correlated by proximity in frequency in order to build the individual ion trace i.e. the frequency evolution with time.

For example, peaks within 60 Hz of another peak, only the highest amplitude peak was selected to avoid picking side lobes that can occur as a result of no apodization. Peaks that survived for at least 100 ms in the STFT corresponded with the initial number of stably trapped ions. In other words, ions must have survived at least 100 ms to be considered trapped. Peaks were assigned to individual ion traces based on their frequency proximity across all of the time steps in the STFT. The ion traces of peaks that overlap over the course of the trapping event were discarded. The length of time each ion was considered to be trapped was determined from the length of the ion trace.

The probability of traces converging depends on a number of factors, including the number of trapped ions, their m/z, their energy and the intrinsic frequency width of the peak. The intrinsic frequency width depends both on the STFT segment length and the collision induced frequency change. Because ions with a range of energies are introduced through the energy selective bending quadrupole and are trapped in this illustration, even ions with the exact same m/z value had a range of frequencies.

The ion energy in each five ms step was obtained from the ratio of peak amplitudes of the fundamental frequency to that of the second harmonic frequency. These data provided m/z values at each five ms interval, which were averaged to obtain a m/z value that was signal averaged for the duration of the trapping event. Similarly, the peak amplitudes of the fundamental frequency, corrected for the amplitudes of higher harmonic frequencies that vary with energy, were averaged to obtain a value for the ion charge.

The mass of each ion was then obtained from the multiplication of the m/z and z values. In order to examine effects of multiple trapped ions on the mass measurement, only ions that survive for the full 1 s of trapping time were used in the mass histograms. If an ion frequency trace converges with another, both ions were excluded. For example, of the 18 ions initially trapped, 11 ions passed these culling criteria and were included in the final mass histogram. In sum, 6988 ions met all of these criteria, and the maximum number of ions included from a single trapping event was 13.

Accordingly, the multiplexing methods were shown to quickly and accurately measure individual masses of multiple simultaneously trapped ions in charge detection mass spectrometry (CDMS) that exceed the capabilities of existing devices.

EXAMPLE 3

To demonstrate that the measured mass is not affected by the number of simultaneously trapped ions and ion-ion interactions, the CDMS methods were applied to samples of bovine serum albumin (66.5 kDa) and RuBisCO (517 kDa) and compared.

It is believed that CDMS analysis of more than one highly charged ion inside of an electrostatic ion trap would lead to interferences in signal due to ion-ion interactions and thus analysis of multiple ions has previously been avoided. However, such interferences from ion-ion interactions are circumvented with the methods.

Figure 6:
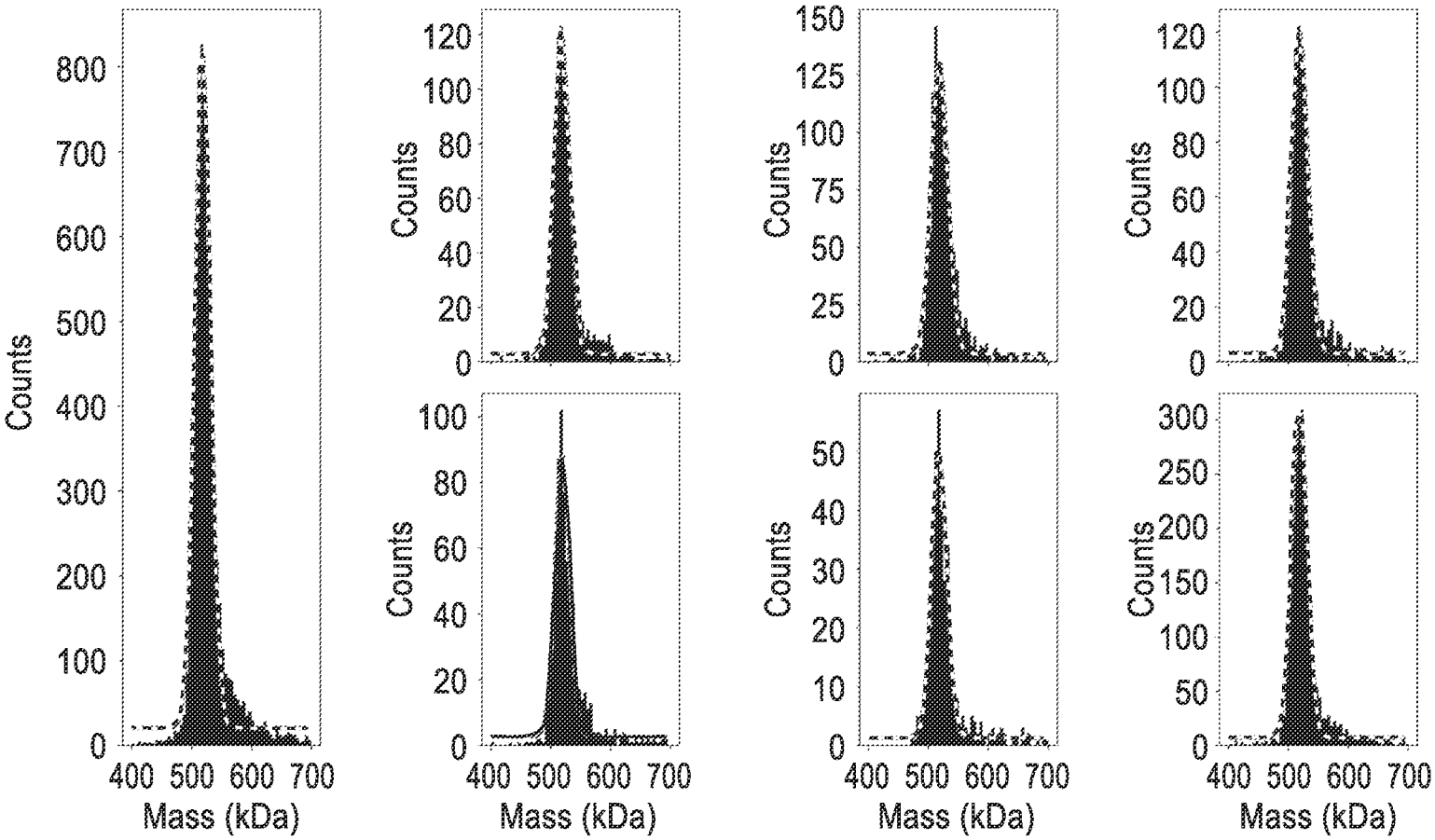
FIG. 6 depicts CDMS mass histograms of RuBisCO ions formed by electrospray ionization. The leftmost histogram comprises all 6988 ions weighed and separate histograms for ion trapping events where 1 through 6+ ions that were simultaneously trapped are shown to the right. A Gaussian fit (dashed) was used to find the peak centroid corresponding to the reported mass of the complex. A linear fit of the peak centroids as a function of number of ions trapped resulted in $R^2$ value of 0.0016 indicating that the measured mass does not depend on the number of ions that are simultaneously trapped.
Figure 7:
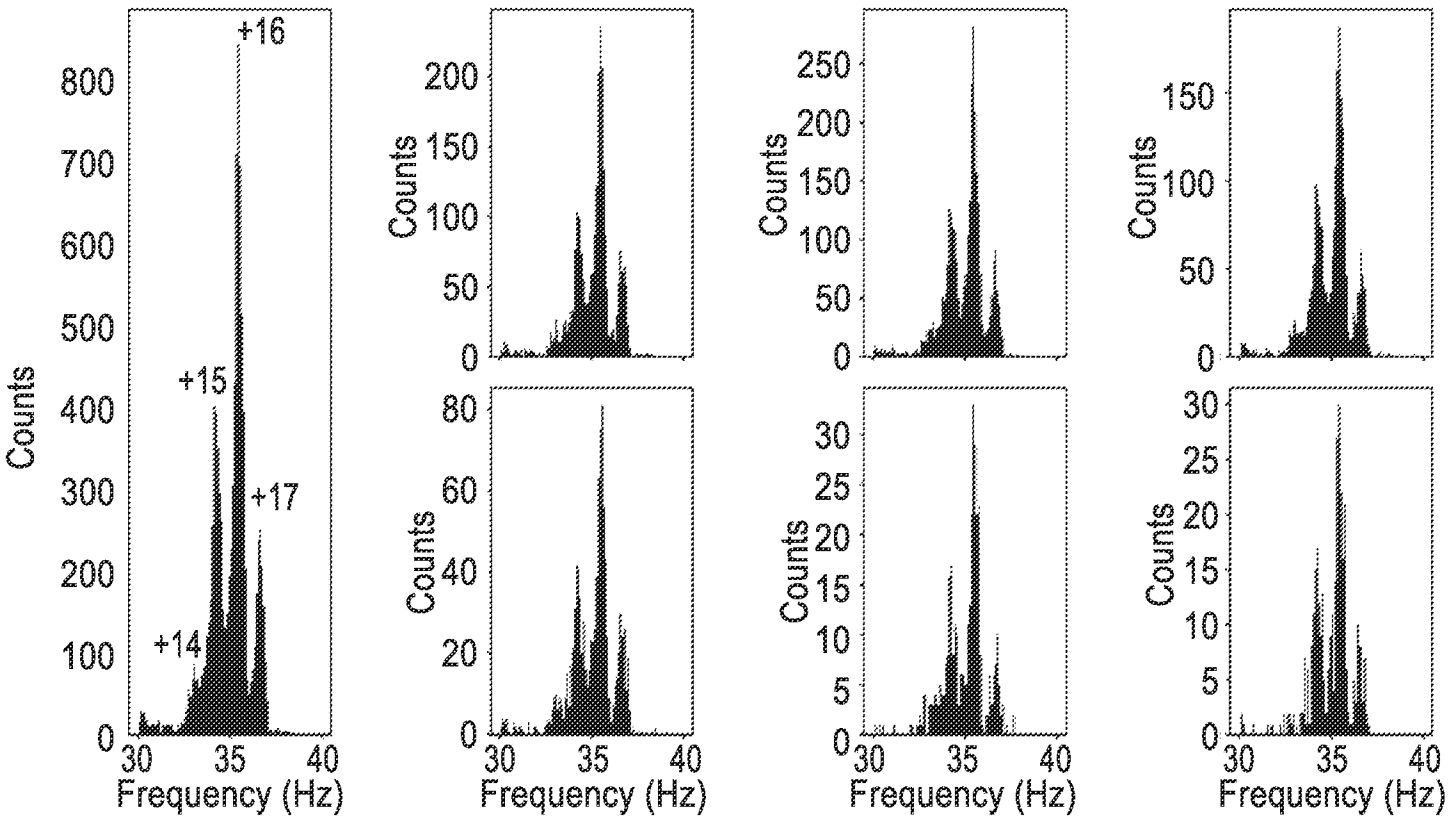
FIG. 7 depicts CDMS mass histograms of bovine serum albumin (66.5 kDa) formed by electrospray ionization showing charge-state distributions resulting from all measurements and from measurements where 1 through 6+ ions were simultaneously trapped. The measured masses that were obtained from these data do not depend on the number of ions that were trapped.

To establish that the presence of multiple ions inside the trap has negligible influence on the measured value of the mass of the sample, RuBisCO and (BSA) were analyzed separately and the results are shown in FIG. 6 and FIG. 7 respectively.

CDMS mass histograms of RuBisCO ions formed by electrospray ionization consisting of all 6988 ions weighed for ion trapping events where 1 through 6+ ions were simultaneously trapped. The results are shown in FIG. 6 and the masses and widths of these distributions are given in Table 1. A Gaussian fit of these data (dashed lines) resulted in a centroid at 517,312 Da with a standard deviation of 13,005 Da (~2.5%). This indicated that the precision of weighing each ion is better than 2.5% because some of this width is due to intrinsic broadening from sample heterogeneity and adduction. Measurement of 6988 ions improved the precision of the overall mass measurement to ~0.03%. The centroid mass of the complex obtained from a deconvolved mass spectrum obtained using a commercial Q-TOF mass spectrometer is 516,900 Da±100 Da. The standard deviation of a Gaussian fitted to the deconvolved data was ~1,700 Da.

The distribution of the number of RuBisCO ions that are trapped is not Poisson due to variations in ion current, both intentional variations and as a result of natural fluctuations in the electrospray apparatus. A linear fit of the centroid of these mass histograms as a function of the number of trapped ions resulted in a $R^2$ value of 0.0016 indicating that the measured mass does not depend on the number of ions trapped within the limits of the ability to obtain mass values with the system.

In another illustration, an ion with m/z 10,550 (corresponding to the 49+ ion) had a peak width of 40 Hz (at peak base) but within the range of energies that was filtered and trapped (~215 to 245 eV/charge), an ion at this m/z can appear at frequencies ranging from 21,500 Hz to 23,250 Hz, a 1750 Hz bandwidth. In principle, 1750/40= approximately 44 ions with the exact same m/z value could still be readily resolved and individually weighed if their energies were evenly dispersed over this range.

In the case of RuBisCO ions with an average of 49+ charges each and up to 21 ions trapped, it was shown that the ion-ion interactions do not adversely affect m/z or mass measurements provided that the ion signals do not overlap, a process made less likely by spreading the ion signal over frequency space using a broad range of ion energies. Accordingly, the ability to analyze the energy of each ion throughout the trap time makes it possible to simultaneously introduce and trap ions that have a broad range of energies. Ions with the exact same m/z can have a range of frequencies so that it is less likely that their signals will overlap. Furthermore, the motion of ions with the same m/z in the multiplexing CDMS method is not coherent, which further reduces the probability of ion-ion interactions.

Ion-ion interactions can potentially adversely affect stable orbits of ions inside the trap leading to more frequent ion loss. In order to determine whether the number of ions that are trapped has any effect on the ion trapping duration, the average trapping time of ions was determined as a function of the number of ions trapped (Table 1). This indicates that the simultaneously trapped multiply charged ions (average 49+ charges) do not interact sufficiently to cause a measurable effect on the ion trapping lifetimes for the 1.0 s maximum duration of these measurements.

Ion-ion interactions depend on ion charge. In order to determine if there were any measurable perturbations in the charge-state distributions as a result of the number of ions that are trapped, bovine serum albumin (BSA) was analyzed using multi-ion CDMS. This protein was chosen because the charge-state distribution is readily resolved. This necessitated lowering the spread of energies of ions entering the trap to a range of approximately 206 eV to 214 eV, which was done using the turning quadrupole. This reduces the ability to multiplex on the basis of ion energy. The m/z distribution from all ions and the distributions from trapping events that contain between 2 and 6+ ions are shown in FIG. 7. There was no apparent variation in the abundance of each charge state that depends on the number of ions in the trapping event. In this case, frequencies were converted to m/z by using the average ion energy. For small proteins with relatively low charge states, such as BSA shown here, more accurate masses can be obtained by introducing a narrow bandwidth of energies and by using the mean energy to calculate m/z. Thus, the methods can be adapted to introduce a broad energy spread of ions and decouple ion frequency and m/z measurements for larger ions that are more highly charged or configured with a narrow energy spread for comparatively smaller ions and lower charge states.

As observed with in the case of RuBisCO, the mass measurement of BSA did not depend on the number of ions trapped. These BSA ions had lower charge states (+13 to +16) than those of RuBisCO (+48 to +52), which reduces ion-ion interactions. However, the frequencies were not distributed as fully in frequency space because of the narrower energy bandwidth, which increases the probability of interference between ion signals and may also increase ion-ion interactions. Accordingly, ion-ion interactions resulting from simultaneously trapped ions did not adversely affect the frequency spectrum, mass measurement or trapping times under the conditions of these experiments.

EXAMPLE 4

To illustrate potential gains in analysis speed by the methods, a 360 second segment of data was acquired with relatively high ion currents to enhance the probability of trapping multiple ions. A total of 1983 ions were trapped for at least 100 ms in these 360 trapping events corresponding to an average of about four ions trapped per event. A total of 1050 of these ions lasted for the full one second trap time and did not overlap in frequency with other ions. Approximately 15% of the initial 1983 ions were discarded due to overlapping ion signals in these data. The mass histogram obtained from these data is similar to that shown in FIG. 6 with a centroid at 519 kDa.

In contrast, only 360×0.37=133 ions could be weighed if this measurement was restricted to conventional single ion analysis with an optimized ion current. If the same proportion of ions are lost or dissociate in the single ion data i.e. do not last the full 1 second, then only about 90 ions would be weighed in this same time period. Thus, the multi-ion multiplexing method makes possible over a 10-fold improvement in analysis speed over ideal single ion analysis. Further gains can almost certainly be made by using an ion current that optimizes the ratio of the number of ions trapped to the number of overlapping ion traces and by widening the energy range of ions that are trapped. Improvements to the data analysis algorithm, including more rigorous treatment of ions with overlapping frequencies, will also increase the number of usable ion signals in each trapping event. A further decrease in analysis time could be obtained in tandem with any of these methods by reducing the length of the trapping events, making it possible to acquire more data in a given time period albeit with reduced mass precision. Trade-offs in analysis time and performance are common with measurements where time-domain data are acquired, such as FT/ICR and orbitrap MS.

It can be seen that the methods can quickly and efficiently provide accurate molecular weight and structural information for large molecular assemblies in a 1 MDa and 1 TDa size range, for example, and for smaller complexes that have high intrinsic heterogeneity or are part of a complex mixture.

From the description herein, it will be appreciated that the present disclosure encompasses multiple embodiments which include, but are not limited to, the following:

1. A method for measuring ion masses in charge detection mass spectrometry (CDMS), the method comprising: (a) providing a source of ions of a sample; (b) simultaneously trapping one or more ions with a range of energies in an electrostatic trap thereby decoupling mass to charge ratio (m/z) and ion oscillation frequency measurements; (c) measuring charge, energy and oscillation frequency time domain signal of each trapped ion; (d) calculating the m/z of each trapped ion from measured energy per charge and measured ion oscillation frequency; and (e) determining ion masses of each ion from the m/z and charge measurements.

2. The method of any preceding or following embodiment, further comprising maximizing the decoupling of mass to charge ratio (m/z) and ion oscillation frequency by increasing the range of ion energies; wherein overlap of ion oscillation frequency signal is reduced; and wherein measurement time is reduced compared to measuring mass of multiple ions simultaneously trapped with a narrow range of energies per charge or ions trapped individually.

3. The method of any preceding or following embodiment, further comprising: performing a Fourier transform on the time domain signal; and obtaining a ratio of amplitudes of fundamental and second harmonic frequencies from the Fourier transform to obtain the energy per charge of each of the ions.

4. The method of any preceding or following embodiment, wherein the Fourier transform comprises a segmented Fourier transform or a short-time Fourier transform (STFT).

5. The method of any preceding or following embodiment, further comprising: averaging calculated m/z values for each ion in measurement segments to obtain an average ion m/z value for each trapped ion; and obtaining an individual ion mass based on the average m/z value.

6. The method of any preceding or following embodiment, further comprising: comparing ion oscillation frequencies for two or more trapped ions; and discarding ions with overlapping frequencies.

7. The method of any preceding or following embodiment, wherein the ions are molecules/complexes with a mass between about 10 MDa to about 1 TDa that are too large for measurement by conventional mass spectrometers.

8. A method for measuring the individual masses of multiple simultaneously trapped ions in charge detection mass spectrometry (CDMS), the method comprising: (a) simultaneously trapping multiple ions in an electrostatic ion trap of a charge detection mass spectrometer; (b) obtaining a ratio of the amplitudes of fundamental frequency to the second harmonic frequency of periodic trapping oscillations of each trapped ion; (c) obtaining an energy per charge from the ratio of amplitudes of each trapped ion; (d) obtaining a mass to charge ratio (m/z) of each the ion from the energy per charge and measured ion oscillation frequency; (e) measuring the charge of each the ion; and (f) obtaining ion masses from the m/z and the charge measurements; (g) wherein mass measurement time is reduced compared to measuring the mass of individually trapped ions.

9. The method of any preceding or following embodiment, further comprising: trapping one or more ions with a range of energies in the electrostatic ion trap thereby decoupling mass to charge ratio (m/z) and ion oscillation frequency measurements.

10. The method of any preceding or following embodiment, further comprising: maximizing the decoupling of mass to charge ratio (m/z) and ion oscillation frequency by increasing the range of ion energies; wherein overlap of ion oscillation frequency signal is reduced; and wherein measurement time is reduced compared to measuring mass of multiple ions simultaneously trapped with a narrow range of energies per charge or ions trapped individually.

11. The method of any preceding or following embodiment, further comprising: averaging calculated m/z values for each ion in measurement segments to obtain an average ion m/z value for each trapped ion; and obtaining an individual ion mass based on the average m/z value.

12. The method of any preceding or following embodiment, further comprising: comparing ion oscillation frequencies for two or more trapped ions; and discarding ions with overlapping frequencies.

13. The method of any preceding or following embodiment, wherein a Fourier transform performed on each ion oscillation frequency signal produces the fundamental and second harmonic frequencies, the transform comprising a segmented Fourier transform or a short-time Fourier transform (STFT).

14. A method for measuring ion masses in charge detection mass spectrometry (CDMS), the method comprising: (a) providing a source of ions of a sample; (b) simultaneously trapping multiple ions in an electrostatic ion trap, the ions having a narrow range of energy per charge determined by energy selective ion optics; (c) measuring charge and oscillation frequency of each trapped ion; (d) calculating the m/z of each trapped ion from an average energy per charge determined by the energy selective ion optics and measured ion oscillation frequency; and (e) determining ion masses of each ion from the m/z and charge measurements.

15. The method of any preceding or following embodiment, further comprising: performing a Fourier transform on the time domain signal; and obtaining a ratio of amplitudes of fundamental and second harmonic frequencies from the Fourier transform to obtain the energy per charge of each of the ions.

16. The method of any preceding or following embodiment, wherein the Fourier transform comprises a segmented Fourier transform or a short-time Fourier transform (STFT).

17. The method of any preceding or following embodiment, further comprising: comparing ion oscillation frequencies for two or more trapped ions; and discarding ions with overlapping frequencies.

18. A charge detection mass spectrometry (CDMS) system for ion mass measurements, comprising: (a) a conventional charge detection mass spectrometry (CDMS) system with an electrospray ionization and an electrostatic ion trap; (b) a detector with energy selective ion optics configured to detect ion oscillation frequency time domain signals and ion energy; and (c) a processor and a non-transitory memory storing instructions executable by the processor, wherein said instructions, when executed by the processor, perform one or more steps comprising: (i) simultaneously trapping multiple ions in the electrostatic ion trap; (ii) measuring charge and oscillation frequency time domain signals of each trapped ion; (iii) determining energy per charge with the energy selective ion optics; (iv) calculating the m/z of each trapped ion from measured energy per charge and measured ion oscillation frequency; and (v) determining ion masses of each ion from the m/z and charge measurements.

19. The system of any preceding or following embodiment, wherein when executed by said processor, said instructions further perform one or more steps comprising: simultaneously trapping multiple ions having a narrow range of energy per charge determined by energy selective ion optics in the electrostatic ion trap; and calculating the m/z of each trapped ion from an average energy per charge determined by the energy selective ion optics and measured ion oscillation frequency.

20. The system of any preceding or following embodiment, wherein when executed by said processor, said instructions further perform one or more steps comprising: simultaneously trapping one or more ions with a range of energies in an electrostatic ion trap thereby decoupling mass to charge ratio (m/z) and ion oscillation frequency measurements.

21. The system of any preceding or following embodiment, wherein when executed by said processor, said instructions further perform one or more steps comprising: maximizing the decoupling of mass to charge ratio (m/z) and ion oscillation frequency by increasing the range of ion energies; wherein overlap of ion oscillation frequency time domain signal is reduced; and wherein measurement time is reduced compared to measuring mass of multiple ions simultaneously trapped with a narrow range of energies per charge or ions trapped individually.

22. The system of any preceding or following embodiment, wherein when executed by said processor, said instructions further perform one or more steps comprising: performing a Fourier transform on the time domain signal; and obtaining a ratio of amplitudes of fundamental and second harmonic frequencies from the Fourier transform to obtain the energy per charge of each of the ions.

23. The system of any preceding or following embodiment, wherein the Fourier transform comprises a segmented Fourier transform or a short-time Fourier transforms (STFT).

24. The system of any preceding or following embodiment, wherein when executed by said processor, said instructions further perform one or more steps comprising: averaging calculated m/z values for each ion in measurement segments to obtain an average ion m/z value for each trapped ion; and obtaining an individual ion mass based on the average m/z value.

25. The system of any preceding or following embodiment, wherein when executed by said processor, said instructions further perform one or more steps comprising: comparing ion oscillation frequencies for two or more trapped ions; and discarding ions with overlapping frequencies.

26. A method for measuring the individual masses of multiple simultaneously trapped ions in charge detection mass spectrometry (CDMS), the method comprising: (a) simultaneously trapping multiple ions; (b) selecting the energy per charge of each said ion; (c) obtaining the m/z of each said ion from said energy per charge and measured ion oscillation frequency; (d) measuring the charge of each said ion; (e) and obtaining ion masses from said m/z and said charge.

27. A method for measuring the individual masses of multiple simultaneously trapped ions in charge detection mass spectrometry (CDMS), the method comprising: (a) simultaneously trapping multiple ions; (b) for each said ion obtaining the ratio of the amplitudes of the fundamental frequency to the second harmonic frequency of the periodic trapping motion; (c) obtaining the energy per charge of each said ion from said ratio for said ion; (d) obtaining the m/z of each said ion from said energy per charge and measured ion oscillation frequency; (e) measuring the charge of each said ion; and (f) obtaining ion masses from said m/z and said charge.

28. The method of any preceding or following embodiment wherein measurement time is reduced compared to measuring the mass of individually trapped ions.

29. A method for measuring the individual masses of multiple simultaneously trapped ions in charge detection mass spectrometry (CDMS), the method comprising: (a) simultaneously trapping multiple ions with a broad range of ion energies per charge; (b) multiplexing measurements of individual masses of said ions; (c) wherein by trapping ions with a range of energies per charge, ion signals are spread over a broad range of frequencies for ions having the same or substantially the same m/z; (d) wherein probability of overlapping ion signals is reduced; and (e) wherein measurement time is reduced compared to measuring mass of multiple ions simultaneously trapped with a narrow range of energies per charge or ions trapped individually.

30. The method of any preceding or following embodiment wherein the probability of ion-ion interference is significantly reduced because ions with substantially the same or the same m/z but with different energies per charge oscillate with different frequencies.

Embodiments of the present technology may be described herein with reference to flowchart illustrations of methods and systems according to embodiments of the technology, and/or procedures, algorithms, steps, operations, formulae, or other computational depictions, which may also be implemented as computer program products. In this regard, each block or step of a flowchart, and combinations of blocks (and/or steps) in a flowchart, as well as any procedure, algorithm, step, operation, formula, or computational depiction can be implemented by various means, such as hardware, firmware, and/or software including one or more computer program instructions embodied in computer-readable program code. As will be appreciated, any such computer program instructions may be executed by one or more computer processors, including without limitation a general purpose computer or special purpose computer, or other programmable processing apparatus to produce a machine, such that the computer program instructions which execute on the computer processor(s) or other programmable processing apparatus create means for implementing the function(s) specified.

Accordingly, blocks of the flowcharts, and procedures, algorithms, steps, operations, formulae, or computational depictions described herein support combinations of means for performing the specified function(s), combinations of steps for performing the specified function(s), and computer program instructions, such as embodied in computer-readable program code logic means, for performing the specified function(s). It will also be understood that each block of the flowchart illustrations, as well as any procedures, algorithms, steps, operations, formulae, or computational depictions and combinations thereof described herein, can be implemented by special purpose hardware-based computer systems which perform the specified function(s) or step(s), or combinations of special purpose hardware and computer-readable program code.

Furthermore, these computer program instructions, such as embodied in computer-readable program code, may also be stored in one or more computer-readable memory or memory devices that can direct a computer processor or other programmable processing apparatus to function in a particular manner, such that the instructions stored in the computer-readable memory or memory devices produce an article of manufacture including instruction means which implement the function specified in the block(s) of the flowchart(s). The computer program instructions may also be executed by a computer processor or other programmable processing apparatus to cause a series of operational steps to be performed on the computer processor or other programmable processing apparatus to produce a computer-implemented process such that the instructions which execute on the computer processor or other programmable processing apparatus provide steps for implementing the functions specified in the block(s) of the flowchart(s), procedure (s) algorithm(s), step(s), operation(s), formula(e), or computational depiction(s).

It will further be appreciated that the terms "programming" or "program executable" as used herein refer to one or more instructions that can be executed by one or more computer processors to perform one or more functions as described herein. The instructions can be embodied in software, in firmware, or in a combination of software and firmware. The instructions can be stored local to the device in non-transitory media, or can be stored remotely such as on a server, or all or a portion of the instructions can be stored locally and remotely. Instructions stored remotely can be downloaded (pushed) to the device by user initiation, or automatically based on one or more factors.

It will further be appreciated that as used herein, that the terms processor, hardware processor, computer processor, central processing unit (CPU), and computer are used synonymously to denote a device capable of executing the instructions and communicating with input/output interfaces and/or peripheral devices, and that the terms processor, hardware processor, computer processor, CPU, and computer are intended to encompass single or multiple devices, single core and multicore devices, and variations thereof.

As used herein, the singular terms "a," "an," and "the" may include plural referents unless the context clearly dictates otherwise. Reference to an object in the singular is not intended to mean "one and only one" unless explicitly so stated, but rather "one or more."

As used herein, the term "set" refers to a collection of one or more objects. Thus, for example, a set of objects can include a single object or multiple objects.

As used herein, the terms "substantially" and "about" are used to describe and account for small variations. When used in conjunction with an event or circumstance, the terms can refer to instances in which the event or circumstance occurs precisely as well as instances in which the event or circumstance occurs to a close approximation. When used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" aligned can refer to a range of angular variation of less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

Additionally, amounts, ratios, and other numerical values may sometimes be presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

TABLE 1

Mass and Average Trapping Lifetimes of RuBisCO Obtained by CDMS Measurements for All Ions and for Events with 1 Through 6+ Simultaneously Trapped Ions

| #Ions Simultaneously Trapped | Mass (Da) | Standard Deviation of Gaussian Fit (Da) | Average Trapping Lifetime (ms) |
|---|---|---|---|
| All | 517,312 | 13,005 | 762.4 |
| 1 | 516,956 | 11,437 | 758.3 |
| 2 | 517,143 | 13,995 | 761.5 |
| 3 | 517,914 | 13,673 | 764.6 |
| 4 | 517,509 | 11,721 | 761.0 |
| 5 | 516,435 | 12,095 | 756.9 |
| 6+ | 517,385 | 13,200 | 766.8 |

What is claimed is:

1. A method for measuring ion masses in charge detection mass spectrometry (CDMS), the method comprising:

(a) providing a source of ions from a sample;

(b) simultaneously trapping multiple ions with a range of energies in an electrostatic trap thereby decoupling mass to charge ratio (m/z) and ion oscillation frequency measurements;

(c) measuring charge, energy per charge and oscillation frequency from a time domain signal of each trapped ion;

(d) calculating the m/z of each trapped ion from measured energy per charge and measured ion oscillation frequency; and (e) determining ion masses of each ion from said m/z and charge measurements.

2. The method of claim 1, further comprising:

maximizing said decoupling of mass to charge ratio (m/z) and ion oscillation frequency by increasing said range of ion energies;

wherein overlap of ion oscillation frequency signals is reduced; and wherein measurement time is reduced compared to measuring individual masses of multiple ions simultaneously trapped with a narrow range of energies per charge or ions trapped individually.

3. The method of claim 1, further comprising:

performing a Fourier transform on the time domain signal; and obtaining a ratio of amplitudes of fundamental and second harmonic frequencies from the Fourier transform to obtain said energy per charge of each of said ions.

4. The method of claim 3, wherein the Fourier transform comprises a segmented Fourier transform or a short-time Fourier transform (STFT).

5. The method of claim 1, further comprising:

averaging calculated m/z values for each ion in measurement segments to obtain an average ion m/z value for each trapped ion; and obtaining an individual ion mass based on the average m/z value.

6. The method of claim 1, further comprising:

comparing ion oscillation frequencies for two or more trapped ions; and discarding ions with overlapping frequencies.

7. The method of claim 1, wherein said ions are molecules/complexes with a mass between about 1 MDa to about 1 TDa or are heterogeneous.

8. A method for measuring the individual masses of multiple simultaneously trapped ions in charge detection mass spectrometry (CDMS), the method comprising:

(a) simultaneously trapping multiple ions in an electrostatic ion trap of a charge detection mass spectrometer;

(b) obtaining a ratio of the amplitudes of fundamental frequency to the second harmonic frequency of periodic trapping oscillations of each trapped ion;

(c) obtaining an energy per charge from said ratio of amplitudes of each trapped ion;

(d) obtaining a mass to charge ratio (m/z) of each said ion from said energy per charge and measured ion oscillation frequency;

(e) measuring the charge of each said ion; and (f) obtaining ion masses from said m/z and said charge measurements;

(g) wherein mass measurement time is reduced compared to measuring the mass of individually trapped ions.

9. The method of claim 8, further comprising:

trapping one or more ions with a range of energies in said electrostatic ion trap thereby decoupling mass to charge ratio (m/z) and ion oscillation frequency measurements.

10. The method of claim 9, further comprising:

maximizing said decoupling of mass to charge ratio (m/z) and ion oscillation frequency by increasing said range of ion energies;

wherein overlap of ion oscillation frequency signals is reduced; and wherein measurement time is reduced compared to measuring individual masses of multiple ions simultaneously trapped with a narrow range of energies per charge or ions trapped individually.

11. The method of claim 8, further comprising:

averaging calculated m/z values for each ion in measurement segments to obtain an average ion m/z value for each trapped ion; and obtaining an individual ion mass based on the average m/z value.

12. The method of claim 8, further comprising:

comparing ion oscillation frequencies for two or more trapped ions; and discarding ions with overlapping frequencies.

13. The method of claim 8, wherein a Fourier transform performed on each time domain signal produces said fundamental frequencies, second harmonic frequencies, and amplitudes, said Fourier transform comprising a segmented Fourier transform or a short-time Fourier transform (STFT).

14. A method for measuring ion masses in charge detection mass spectrometry (CDMS), the method comprising:

(a) providing a source of ions from a sample;

(b) simultaneously trapping multiple ions in an electrostatic ion trap, said ions having a narrow range of energy per charge determined by energy selective ion optics;

(c) measuring charge and oscillation frequency of each trapped ion;

(d) calculating the m/z of each trapped ion from an average energy per charge determined by the energy selective ion optics and measured ion oscillation frequency; and (e) determining ion masses of each ion from said m/z and charge measurements.

15. The method of claim 14, further comprising:

performing a Fourier transform on the time domain signal; and obtaining a ratio of amplitudes of fundamental and second harmonic frequencies from the Fourier transform to obtain said energy per charge of each of said ions.

16. The method of claim 15, wherein the Fourier transform comprises a segmented Fourier transform or a short-time Fourier transform (STFT).

17. The method of claim 14, further comprising:

comparing ion oscillation frequencies for two or more trapped ions; and discarding ions with overlapping frequencies.

18. A charge detection mass spectrometry (CDMS) system for ion mass measurements, comprising:

(a) a conventional charge detection mass spectrometry (CDMS) system with electrospray ionization and an electrostatic ion trap;

(b) a detector configured to detect ion oscillation frequency time domain signals, and energy selective ion optics configured to determine ion energy; and (c) a processor and a non-transitory memory storing instructions executable by the processor, wherein said instructions, when executed by the processor, perform one or more steps comprising:

(i) simultaneously trapping multiple ions in the electrostatic ion trap;

(ii) measuring charge and oscillation frequency from time domain signals of each trapped ion;

(iii) determining energy per charge for each trapped ion with said energy selective ion optics;

(iv) calculating the m/z of each trapped ion from said energy per charge and measured ion oscillation frequency; and (v) determining ion masses of each ion from said m/z and charge measurements.

19. The system of claim 18, wherein when executed by said processor, said instructions further perform one or more steps comprising:

simultaneously trapping multiple ions having a narrow range of energy per charge determined by energy selective ion optics in said electrostatic ion trap; and calculating the m/z of each trapped ion from an average energy per charge determined by the energy selective ion optics and measured ion oscillation frequency.

20. The system of claim 18, wherein when executed by said processor, said instructions further perform one or more steps comprising:

simultaneously trapping one or more ions with a range of energies in an electrostatic ion trap thereby decoupling mass to charge ratio (m/z) and ion oscillation frequency measurements.

21. The system of claim 20, wherein when executed by said processor, said instructions further perform one or more steps comprising:

maximizing said decoupling of mass to charge ratio (m/z) and ion oscillation frequency by increasing said range of ion energies;

wherein overlap of ion oscillation frequency signals is reduced; and wherein measurement time is reduced compared to measuring individual masses of multiple ions simultaneously trapped with a narrow range of energies per charge or ions trapped individually.

22. The system of claim 18, wherein when executed by said processor, said instructions further perform one or more steps comprising:

performing a Fourier transform on the time domain signal; and obtaining a ratio of amplitudes of fundamental and second harmonic frequencies from the Fourier transform to obtain said energy per charge of each of said ions.

23. The system of claim 22, wherein the Fourier transform comprises a segmented Fourier transform or a short-time Fourier transforms (STFT).

24. The system of claim 18, wherein when executed by said processor, said instructions further perform one or more steps comprising:

averaging calculated m/z values for each ion in measurement segments to obtain an average ion m/z value for each trapped ion; and obtaining an individual ion mass based on the average m/z value.

25. The system of claim 18, wherein when executed by said processor, said instructions further perform one or more steps comprising:

comparing ion oscillation frequencies for two or more trapped ions; and discarding ions with overlapping frequencies.

* * * * *